US010721987B2

(12) United States Patent
Lowe

(10) Patent No.: US 10,721,987 B2
(45) Date of Patent: Jul. 28, 2020

(54) PROTECTIVE HELMET

(71) Applicant: Bell Sports, Inc., Scotts Valley, CA (US)

(72) Inventor: Michael W. Lowe, Santa Cruz, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 461 days.

(21) Appl. No.: 14/925,874

(22) Filed: Oct. 28, 2015

(65) Prior Publication Data

US 2016/0113346 A1 Apr. 28, 2016

Related U.S. Application Data

(60) Provisional application No. 62/069,679, filed on Oct. 28, 2014.

(51) Int. Cl.
*A42B 3/10* (2006.01)
*A42B 3/06* (2006.01)

(52) U.S. Cl.
CPC ..... *A42B 3/105* (2013.01); *A42B 3/064* (2013.01)

(58) Field of Classification Search
CPC ..... A42B 3/105; A42B 3/064; A42B 3/063; A42B 3/066; A42B 3/10; A42B 3/12; A42B 3/122; A42B 3/125; A42B 3/127; A42B 3/128; A42B 3/00; A42B 3/04; A42B 3/0473; A42B 3/06; A42B 3/062;
(Continued)

(56) References Cited

U.S. PATENT DOCUMENTS 1,262,818 A 4/1918 McGill
1,522,952 A 1/1925 Hugo
1,655,007 A 1/1928 Boettge
(Continued)

FOREIGN PATENT DOCUMENTS

CA 2778050 A1 4/2011
CH 692011 1/2002
(Continued)

OTHER PUBLICATIONS

International Search Report from PCT/US2015/057894 dated Mar. 10, 2016 (2 pages).
(Continued)

*Primary Examiner* — Anna K Kinsaul
*Assistant Examiner* — F Griffin Hall
(74) *Attorney, Agent, or Firm* — Barnes & Thornburg LLP

(57) ABSTRACT

A protective helmet having a protective shell, a low friction layer, and a comfort liner is disclosed. The protective shell includes an energy absorbing material and an inner surface. The low friction layer is coupled to the inner surface of the protective shell. The low friction layer may be plastic having a thickness of less than approximately 3 mm. The comfort liner is removably coupled to the low friction layer opposite the protective shell, and includes a low friction material, such as brushed nylon, adjacent the low friction liner. The comfort liner may be removeably coupled protective shell with either clips that removably couple to receivers embedded in the brow of the helmet, with elastically deformable couplings that extend from the comfort liner to the protective shell, or both.

23 Claims, 7 Drawing Sheets

(58) Field of Classification Search
CPC ..... A42B 3/14; A42B 3/142; A42B 3/147; A42B 3/145
USPC ..... 2/412, 410, 411, 413, 414, 415, 416
See application file for complete search history.

(56) References Cited

U.S. PATENT DOCUMENTS 1,691,202 A 11/1928 La Reabourne
1,705,879 A 3/1929 Rodgers
1,833,708 A 11/1931 Ford
2,140,716 A 12/1938 Pryale
2,150,290 A 3/1939 Mulvey
2,194,903 A 3/1940 Holstein
2,250,275 A 7/1941 Riddell
2,296,335 A 9/1942 Brady
2,354,840 A 8/1944 Emil
2,359,387 A 10/1944 Riddell
2,451,483 A 10/1948 Hugo
2,570,182 A 10/1951 Daly
2,634,415 A 4/1953 Turner
2,679,046 A 5/1954 Dye
2,688,747 A 9/1954 Erich
2,758,304 A 8/1956 McGowan
2,768,380 A 10/1956 Golomb
2,777,127 A 1/1957 Marietta
2,861,272 A 11/1958 Stuart
2,904,645 A 9/1959 Sarles
2,969,546 A 1/1961 Morgan, Jr.
3,039,108 A 6/1962 Lohrenz
3,082,427 A * 3/1963 Zbikowski ..... A42B 3/14 2/416
3,153,973 A 10/1964 Marietta
3,155,981 A 11/1964 McKissick
3,166,761 A 1/1965 Elwood
3,167,783 A 2/1965 Wolfe
3,174,155 A 3/1965 Pitman
3,186,004 A 6/1965 Carlini
3,187,342 A 6/1965 Aileo
3,189,917 A 6/1965 Sims
3,197,784 A 8/1965 Sheldon
3,208,080 A 9/1965 Hirsch
3,223,086 A 12/1965 Denton
3,274,612 A 9/1966 Merriam
3,274,613 A 9/1966 Sowle
3,292,180 A 12/1966 Marietta
3,296,582 A 1/1967 Ide
3,315,272 A 4/1967 Olt
3,323,134 A 6/1967 Swyers
3,344,433 A 10/1967 Stapenhill
3,364,499 A 1/1968 Kwoka
3,447,162 A 6/1969 Aileo
3,447,163 A 6/1969 Bothwell
3,462,763 A 8/1969 Schneider
3,478,365 A 11/1969 Varga
3,500,472 A 3/1970 Castellani
3,548,409 A 12/1970 Aileo
3,548,410 A 12/1970 Parker
3,566,409 A 3/1971 Hopper
3,568,210 A 3/1971 Marietta
3,577,562 A 5/1971 Holt
3,590,388 A 7/1971 Holt
3,600,714 A 8/1971 Greathouse
3,605,113 A 9/1971 Marietta
3,609,764 A 10/1971 Morgan
3,616,463 A 11/1971 Theodore
3,629,864 A 12/1971 Latina
3,713,640 A 1/1973 Margan
3,720,955 A 3/1973 Rawlings
3,729,744 A 5/1973 Rappleyea
3,761,959 A 10/1973 Dunning
3,783,450 A 1/1974 Connor
3,785,395 A 1/1974 Andreasson
3,793,241 A 2/1974 Kyle
3,815,152 A 6/1974 Bednarczuk
3,818,508 A 6/1974 Lammers
3,820,163 A 6/1974 Rappleyea
3,843,970 A 10/1974 Marietta
3,849,801 A 11/1974 Holt
3,872,511 A 3/1975 Nichols
3,882,547 A 5/1975 Morgan
3,934,271 A 1/1976 Rhee
3,946,441 A 3/1976 Johnson
3,992,721 A 11/1976 Morton
3,994,020 A 11/1976 Villari
3,994,021 A 11/1976 Villari
3,994,022 A 11/1976 Villari
3,999,220 A 12/1976 Keltner
4,006,496 A 2/1977 Marker
4,023,209 A 5/1977 Frieder
4,023,213 A 5/1977 Rovani
4,028,743 A 6/1977 Christensen
4,035,847 A * 7/1977 Prince ..... A42B 3/14 2/416
4,038,700 A 8/1977 Gyory
4,054,953 A 10/1977 De Barsy
4,060,855 A 12/1977 Rappleyea
4,064,565 A 12/1977 Griffiths
4,075,714 A 2/1978 Ryder
4,101,983 A 7/1978 Dera
4,272,853 A 6/1981 Schuessler
4,279,038 A 7/1981 Brueckner
4,282,610 A 8/1981 Steigerwald
4,287,613 A 9/1981 Schulz
4,307,471 A * 12/1981 Lovell ..... A42B 3/065 2/411
4,345,338 A 8/1982 Frieder, Jr.
4,354,284 A 10/1982 Gooding
D267,287 S 12/1982 Gooding
4,363,140 A 12/1982 Correale
4,370,759 A 2/1983 Zide
4,375,108 A 3/1983 Gooding
4,398,306 A 8/1983 Gooding
4,404,690 A 9/1983 Farquharson
4,432,099 A 2/1984 Grick
4,434,514 A 3/1984 Sundahl
4,463,456 A 8/1984 Hanson
4,475,248 A 10/1984 L Abbe
4,477,929 A 10/1984 Mattsson
4,478,587 A 10/1984 Mackal
4,534,068 A 8/1985 Mitchell
4,555,816 A 12/1985 Broersma
4,566,137 A 1/1986 Gooding
4,627,115 A 12/1986 Broersma
4,665,569 A 5/1987 Santini
4,677,694 A 7/1987 Crow
4,706,305 A 11/1987 Cho
4,724,549 A 2/1988 Herder
4,741,054 A 5/1988 Mattes
4,766,614 A 8/1988 Cantwell
4,774,729 A 10/1988 Coates
4,794,652 A 1/1989 Piech Von Planta
4,808,469 A 2/1989 Hiles
4,821,344 A * 4/1989 Kamata ..... A42B 3/12 2/181.6
4,831,668 A 5/1989 Schulz
4,853,980 A 8/1989 Zarotti
4,885,806 A 12/1989 Heller
4,903,346 A 2/1990 Reddemann
4,916,759 A 4/1990 Arai
4,937,888 A 7/1990 Straus
4,982,452 A 1/1991 Chaise
4,996,724 A 3/1991 Dextrase
5,012,533 A 5/1991 Raffler
5,014,365 A 5/1991 Schulz
5,031,246 A 7/1991 Kronenberger
5,035,009 A 7/1991 Wingo, Jr.
5,044,016 A 9/1991 Coombs
5,056,162 A 10/1991 Tirums
5,083,321 A 1/1992 Davidsson
5,093,936 A 3/1992 Copeland
5,093,937 A 3/1992 Kamata
5,093,939 A 3/1992 Noyerie
5,101,517 A 4/1992 Douglas
5,129,108 A 7/1992 Copeland

(56) References Cited

U.S. PATENT DOCUMENTS 5,136,728 A 8/1992 Kamata
5,150,479 A * 9/1992 Oleson ..... A42B 3/125 2/414
5,165,116 A 11/1992 Simpson
5,175,889 A 1/1993 Infusino
5,177,815 A 1/1993 Andujar
5,204,998 A 4/1993 Liu
5,231,703 A 8/1993 Garneau
5,263,203 A 11/1993 Kraemer
5,263,204 A 11/1993 Butsch
5,271,103 A 12/1993 Darnell
5,272,773 A 12/1993 Kamata
5,298,208 A 3/1994 Sibley
5,309,576 A 5/1994 Broersma
5,315,718 A * 5/1994 Barson ..... A42B 3/08 2/418
RE34,699 E 8/1994 Copeland
5,345,614 A 9/1994 Tanaka
D357,555 S 4/1995 Brueckner
5,418,257 A 5/1995 Weisman
5,448,780 A 9/1995 Gath
5,461,730 A 10/1995 Carrington
D364,487 S 11/1995 Tutton
5,493,736 A 2/1996 Allison
5,517,691 A 5/1996 Blake
5,522,091 A 6/1996 Rudolf
5,539,936 A 7/1996 Thomas
5,544,367 A 8/1996 March, II
5,553,330 A 9/1996 Carveth
5,621,922 A 4/1997 Rush, III
5,655,227 A 8/1997 Sundberg
5,661,854 A 9/1997 March, II
5,713,082 A 2/1998 Bassette
5,724,681 A 3/1998 Sykes
5,732,414 A 3/1998 Monica
5,734,994 A 4/1998 Rogers
5,737,770 A 4/1998 Chen
5,790,988 A 8/1998 Guadagnino, Jr.
5,794,270 A * 8/1998 Howat ..... A42B 3/0473 2/410
5,794,271 A 8/1998 Hastings
5,833,796 A 11/1998 Matich
5,867,840 A 2/1999 Hirosawa
D406,399 S 3/1999 Hohdorf
5,883,145 A 3/1999 Hurley
5,913,412 A 6/1999 Huber
5,915,537 A 6/1999 Dallas
5,930,840 A 8/1999 Arai
5,938,878 A 8/1999 Hurley
5,941,272 A 8/1999 Feldman
5,943,706 A 8/1999 Miyajima
5,950,244 A 9/1999 Fournier
5,956,777 A 9/1999 Popovich
6,032,297 A * 3/2000 Barthold ..... A42B 3/10 2/416
6,047,400 A 4/2000 Spencer
6,054,005 A 4/2000 Hurley
6,070,271 A 6/2000 Williams
6,073,271 A 6/2000 Alexander
6,079,053 A 6/2000 Clover, Jr.
6,089,251 A 7/2000 Pestel
6,128,786 A 10/2000 Maddux
6,138,284 A 10/2000 Arai
6,154,889 A 12/2000 Moore, III
6,159,324 A 12/2000 Watters
6,178,560 B1 1/2001 Halstead
6,219,850 B1 4/2001 Halstead
6,226,801 B1 5/2001 Alexander
6,240,571 B1 6/2001 Infusino
D445,962 S 7/2001 Brignone
6,256,798 B1 7/2001 Egolf
6,272,692 B1 8/2001 Abraham
D448,526 S 9/2001 Brignone
6,282,724 B1 9/2001 Abraham
D448,890 S 10/2001 Brignone
6,298,497 B1 10/2001 Chartrand
6,314,586 B1 11/2001 Duguid
6,332,228 B1 12/2001 Takahara
6,339,849 B1 1/2002 Nelson
6,351,853 B1 3/2002 Halstead
6,360,376 B1 3/2002 Carrington
6,370,699 B1 4/2002 Halstead
6,385,780 B1 5/2002 Racine
6,389,607 B1 5/2002 Wood
D459,032 S 6/2002 Gatellet
D459,554 S 6/2002 Gatellet
D459,555 S 6/2002 Gatellet
6,421,841 B2 7/2002 Ikeda
6,434,755 B1 8/2002 Halstead
6,438,762 B1 8/2002 Jenkins
6,438,763 B2 8/2002 Guay
6,446,270 B1 9/2002 Durr
6,467,099 B2 10/2002 Dennis
D466,651 S 12/2002 Halstead
D475,486 S 6/2003 Ide
6,604,246 B1 8/2003 Obreja
6,658,671 B1 * 12/2003 Von Holst ..... A42B 3/064 2/412
6,701,535 B2 3/2004 Dobbie
D492,818 S 7/2004 Ide
6,785,985 B2 9/2004 Marvin
6,826,509 B2 11/2004 Crisco, III
6,874,170 B1 * 4/2005 Aaron ..... A41D 13/0512 2/468
6,880,176 B2 4/2005 Timms
6,925,657 B2 8/2005 Takahashi
6,931,671 B2 8/2005 Skiba
6,934,971 B2 8/2005 Ide
D521,191 S 5/2006 Berger
D523,180 S 6/2006 Frye
7,062,795 B2 6/2006 Skiba
7,111,329 B2 9/2006 Stroud
7,140,049 B2 11/2006 Lang-Ree
7,243,378 B2 7/2007 Desarmaux
7,341,776 B1 3/2008 Milliren
D570,055 S 5/2008 Ferrara
7,328,462 B1 12/2008 Straus
D617,503 S 6/2010 Szalkowski
7,735,157 B2 6/2010 Ikeda
7,743,640 B2 6/2010 Lampe
7,802,320 B2 9/2010 Morgan
7,832,023 B2 11/2010 Crisco
7,870,617 B2 1/2011 Butler
7,900,279 B2 3/2011 Kraemer
7,917,972 B1 4/2011 Krueger
7,930,771 B2 4/2011 Depreitere
7,987,525 B2 8/2011 Summers
8,015,624 B2 9/2011 Baldackin
8,087,099 B2 * 1/2012 Sawabe ..... A42B 3/324 2/411
8,117,679 B2 2/2012 Pierce
8,156,569 B2 4/2012 Cripton
8,191,179 B2 6/2012 Durocher
8,201,269 B2 6/2012 Maddux
D663,076 S 7/2012 Parsons
8,209,784 B2 7/2012 Maddux
D666,779 S 9/2012 Harris
8,296,867 B2 10/2012 Rudd
8,296,868 B2 10/2012 Belanger
D671,271 S 11/2012 Votel
8,328,159 B2 12/2012 Lee
D679,058 S 3/2013 Szalkowski
8,418,270 B2 4/2013 Desjardins
8,499,366 B2 8/2013 Nimmons
8,524,338 B2 9/2013 Anderson
8,544,117 B2 10/2013 Erb
8,544,118 B2 10/2013 Brine, III
8,566,968 B2 10/2013 Marzec
8,578,520 B2 11/2013 Halldin
8,640,267 B1 2/2014 Cohen
8,656,520 B2 2/2014 Rush, III
8,707,470 B1 4/2014 Novicky
8,719,967 B2 5/2014 Milsom
8,726,424 B2 5/2014 Thomas

(56) References Cited

U.S. PATENT DOCUMENTS 8,739,317 B2 6/2014 Abernethy
8,756,719 B2 6/2014 Veazie
8,776,272 B1 7/2014 Straus
8,793,816 B2 8/2014 Larkin
8,814,150 B2 8/2014 Ferrara
8,826,468 B2 9/2014 Harris
8,850,622 B2 10/2014 Finiel
8,850,623 B1 10/2014 Mazzoccoli
8,887,312 B2 11/2014 Bhatnagar
8,887,318 B2 11/2014 Mazzarolo
8,955,169 B2 2/2015 Weber
8,966,671 B2 3/2015 Rumbaugh
9,017,806 B2 4/2015 Jacobsen
9,095,179 B2 8/2015 Kwan
9,107,466 B2 8/2015 Hoying
9,113,672 B2 8/2015 Witcher
9,119,431 B2 9/2015 Bain
9,179,727 B2 11/2015 Grant
9,194,136 B2 11/2015 Cormier
9,210,961 B2 12/2015 Torres
9,249,853 B2 2/2016 Cormier
9,314,060 B2 4/2016 Giles
9,314,062 B2 4/2016 Marz
9,320,311 B2 4/2016 Szalkowski
9,332,800 B2 5/2016 Brown
9,380,823 B2 7/2016 Johnson
9,388,873 B1 7/2016 Phipps
9,408,423 B2 8/2016 Guerra
9,420,843 B2 8/2016 Cormier
9,440,413 B2 9/2016 Lewis
9,462,840 B2 10/2016 Leon
9,462,842 B2 10/2016 Hoshizaki
9,474,316 B2 10/2016 Berry
9,493,643 B2 11/2016 Li
9,498,014 B2 11/2016 Wingo
9,516,910 B2 12/2016 Szalkowski
9,545,125 B2 1/2017 Yoon
9,545,127 B1 1/2017 Sandifer
9,554,611 B2 1/2017 Arrouart
9,566,497 B2 2/2017 Erb
9,572,390 B1 2/2017 Simpson
9,572,391 B2 2/2017 McInnis
9,578,917 B2 2/2017 Cohen
9,622,534 B2 4/2017 Cormier
9,642,410 B2 5/2017 Grice
9,656,148 B2 5/2017 Bologna
9,713,355 B2 7/2017 Daoust
9,726,249 B2 8/2017 Horstemeyer
9,750,296 B2 9/2017 Knight
9,763,487 B1 9/2017 Brown, Jr.
9,763,488 B2 9/2017 Bologna
9,770,060 B2 9/2017 Infusino
9,788,589 B2 10/2017 Lewis
9,795,180 B2 10/2017 Lowe
9,801,424 B2 10/2017 Mazzarolo
9,833,033 B2 12/2017 Erb
9,839,251 B2 12/2017 Pannikottu
9,841,075 B2 12/2017 Russo
9,968,154 B2 5/2018 Tenenbaum
10,029,633 B2 7/2018 Phipps
10,039,338 B2 8/2018 Kelly
10,085,508 B2 10/2018 Surabhi
10,105,584 B1 10/2018 Whitcomb
10,130,133 B2 11/2018 Leon
10,130,134 B2 11/2018 Blair
10,136,691 B2 11/2018 Degolier
10,143,255 B2 12/2018 Golnaraghi
10,149,511 B2 12/2018 Vito
10,159,296 B2 12/2018 Pietrzak
10,165,818 B2 1/2019 Suddaby
10,178,889 B2 1/2019 Wacter
10,183,423 B2 1/2019 Nauman
2001/0007716 A1 7/2001 Cutler
2001/0032351 A1* 10/2001 Nakayama ..... A42B 3/064 2/412
2001/0034895 A1 11/2001 Ikeda
2002/0114859 A1 8/2002 Cutler
2003/0209241 A1 11/2003 Fournier
2004/0117896 A1* 6/2004 Madey ..... A42B 3/064 2/411
2004/0139531 A1 7/2004 Moore
2004/0250340 A1* 12/2004 Piper ..... A42B 3/064 2/411
2004/0255364 A1 12/2004 Feher
2004/0261157 A1 12/2004 Talluri
2005/0050617 A1 3/2005 Moore
2005/0241048 A1 11/2005 Cattaneo
2005/0278834 A1* 12/2005 Lee ..... A42B 3/12 2/424
2006/0031978 A1 2/2006 Pierce
2006/0038694 A1 2/2006 Naunheim
2006/0059605 A1 3/2006 Ferrara
2006/0059606 A1* 3/2006 Ferrara ..... A01N 25/18 2/412
2006/0070170 A1 4/2006 Copeland
2006/0143807 A1 7/2006 Udelhofen
2006/0179537 A1 8/2006 Dennis
2006/0242752 A1 11/2006 Talluri
2007/0000032 A1 1/2007 Morgan
2007/0011797 A1 1/2007 Ikeda
2007/0094769 A1 5/2007 Lakes
2007/0151003 A1 7/2007 Shih
2007/0157370 A1 7/2007 Des Ouches
2007/0192944 A1 8/2007 Kraemer
2008/0052808 A1 3/2008 Leick
2008/0086916 A1 4/2008 Ellis
2008/0155734 A1 7/2008 Yen
2008/0172774 A1 7/2008 Ytterborn
2008/0250550 A1 10/2008 Bologna
2008/0256686 A1 10/2008 Ferrara
2009/0031479 A1 2/2009 Rush, III
2009/0038055 A1 2/2009 Ferrara
2009/0183301 A1 7/2009 Brown
2009/0222964 A1 9/2009 Wiles
2009/0255036 A1* 10/2009 Lim ..... A42B 3/10 2/422
2009/0260133 A1 10/2009 Del Rosario
2010/0000009 A1 1/2010 Morgan
2010/0005573 A1 1/2010 Rudd
2010/0043127 A1 2/2010 Wang
2010/0180362 A1* 7/2010 Glogowski ..... A42B 3/145 2/411
2010/0258988 A1* 10/2010 Darnell ..... A42B 3/064 267/141
2010/0287687 A1 11/2010 Ho
2010/0299813 A1 12/2010 Morgan
2010/0319110 A1 12/2010 Preston-Powers
2011/0047680 A1 3/2011 Hoying
2011/0107503 A1* 5/2011 Morgan ..... A42B 3/124 2/456
2011/0131695 A1 6/2011 Maddux
2011/0167541 A1* 7/2011 Chilson ..... A42B 3/062 2/411
2011/0167542 A1 7/2011 Bayne
2011/0203038 A1 8/2011 Jones
2011/0209272 A1 9/2011 Drake
2011/0215931 A1 9/2011 Callsen
2011/0225706 A1 9/2011 Pye
2011/0229685 A1 9/2011 Lin
2011/0271428 A1 11/2011 Withnall
2012/0005810 A1 1/2012 Cheng
2012/0011639 A1 1/2012 Beauchamp
2012/0036619 A1 2/2012 Ytterborn
2012/0047635 A1 3/2012 Finiel
2012/0060251 A1* 3/2012 Schimpf ..... A42B 3/064 2/5
2012/0079646 A1 4/2012 Belanger
2012/0096631 A1 4/2012 King
2012/0151663 A1 6/2012 Rumbaugh
2012/0180199 A1 7/2012 Chilson
2012/0198604 A1 8/2012 Weber
2012/0204327 A1 8/2012 Faden
2012/0210498 A1 8/2012 Mack

(56) References Cited

U.S. PATENT DOCUMENTS

| | | | | |
|---|---|---|---|---|
| 2012/0233745 | A1 | 9/2012 | Veazie | |
| 2012/0291183 | A1 | 11/2012 | Janisse et al. | |
| 2012/0317704 | A1 | 12/2012 | Coyle | |
| 2012/0317705 | A1 | 12/2012 | Lindsay | |
| 2013/0000015 | A1 | 1/2013 | Marzec | |
| 2013/0000017 | A1* | 1/2013 | Szalkowski | A42B 3/127 2/414 |
| 2013/0000018 | A1 | 1/2013 | Rudd | |
| 2013/0007950 | A1 | 1/2013 | Arai | |
| 2013/0025032 | A1* | 1/2013 | Durocher | A42B 3/064 2/414 |
| 2013/0040524 | A1* | 2/2013 | Halldin | B32B 5/022 442/326 |
| 2013/0042396 | A1 | 2/2013 | Wehtje | |
| 2013/0061371 | A1 | 3/2013 | Phipps | |
| 2013/0061375 | A1 | 3/2013 | Bologna | |
| 2013/0122256 | A1 | 5/2013 | Kleiven | |
| 2013/0180034 | A1 | 7/2013 | Preisler | |
| 2013/0232668 | A1 | 9/2013 | Suddaby | |
| 2013/0283503 | A1 | 10/2013 | Zilverberg | |
| 2013/0298316 | A1 | 11/2013 | Jacob | |
| 2013/0340146 | A1 | 12/2013 | Dekker | |
| 2014/0000012 | A1 | 1/2014 | Mustapha | |
| 2014/0007324 | A1 | 1/2014 | Svehaug | |
| 2014/0013492 | A1 | 1/2014 | Bottlang | |
| 2014/0020158 | A1 | 1/2014 | Parsons | |
| 2014/0033402 | A1 | 2/2014 | Donnadieu | |
| 2014/0090155 | A1 | 4/2014 | Johnston | |
| 2014/0196198 | A1 | 7/2014 | Cohen | |
| 2014/0201889 | A1 | 7/2014 | Pietrzak | |
| 2014/0208486 | A1 | 7/2014 | Krueger | |
| 2014/0259309 | A1 | 9/2014 | Pettersen | |
| 2014/0338104 | A1 | 11/2014 | Vito | |
| 2014/0366252 | A1* | 12/2014 | Mazzarolo | A42B 3/127 2/414 |
| 2014/0373257 | A1 | 12/2014 | Turner | |
| 2015/0074875 | A1 | 3/2015 | Schimpf | |
| 2015/0089725 | A1 | 4/2015 | Lowe | |
| 2015/0107005 | A1 | 4/2015 | Schneider | |
| 2015/0121609 | A1 | 5/2015 | Cote | |
| 2015/0157083 | A1 | 6/2015 | Lowe | |
| 2015/0223546 | A1 | 8/2015 | Cohen | |
| 2015/0264991 | A1 | 9/2015 | Frey | |
| 2016/0053843 | A1 | 2/2016 | Subhash | |
| 2016/0058092 | A1 | 3/2016 | Aldino | |
| 2016/0073723 | A1 | 3/2016 | Halldin | |
| 2016/0088884 | A1* | 3/2016 | Guerra | A42B 3/064 2/411 |
| 2016/0113346 | A1 | 4/2016 | Lowe | |
| 2016/0255900 | A1 | 9/2016 | Browd | |
| 2017/0065018 | A1 | 3/2017 | Lindsay | |
| 2017/0164678 | A1* | 6/2017 | Allen | A42B 3/064 |
| 2017/0188649 | A1* | 7/2017 | Allen | A42B 3/003 |

FOREIGN PATENT DOCUMENTS

| | | | |
|---|---|---|---|
| CN | 102972901 | | 3/2013 |
| DE | 3338188 | | 5/1985 |
| DE | 3603234 | | 8/1987 |
| DE | 3632525 | | 8/1996 |
| DE | 19745960 | | 10/1997 |
| EP | 0512193 | | 11/1992 |
| EP | 571065 | | 11/1993 |
| EP | 623292 | | 11/1994 |
| EP | 630589 | | 12/1994 |
| EP | 770338 | | 5/1997 |
| EP | 1219189 | A1 | 7/2002 |
| EP | 1388300 | | 2/2004 |
| EP | 1538935 | A1 | 6/2005 |
| EP | 1627575 | A1 | 2/2006 |
| EP | 1708587 | A1 | 10/2006 |
| EP | 1836913 | A2 | 9/2007 |
| EP | 2042048 | A2 | 4/2009 |
| EP | 2071969 | A2 | 6/2009 |
| EP | 2103229 | A2 | 9/2009 |
| EP | 2156761 | A2 | 2/2010 |
| EP | 2289360 | A2 | 3/2011 |
| EP | 2389822 | A | 11/2011 |
| EP | 2428129 | A2 | 3/2012 |
| GB | 256430 | | 8/1926 |
| GB | 2481855 | A | 1/2012 |
| JP | S57205511 | | 12/1982 |
| JP | H05132809 | | 5/1993 |
| JP | H07109609 | | 4/1995 |
| JP | H07126908 | | 5/1995 |
| JP | H10195707 | | 7/1998 |
| JP | 2001020121 | | 1/2001 |
| RU | 2150874 | | 6/2000 |
| WO | 9534229 | | 12/1995 |
| WO | 1998023174 | | 6/1998 |
| WO | 1999042012 | | 8/1999 |
| WO | 2000067998 | | 11/2000 |
| WO | 0152676 | | 7/2001 |
| WO | 2002028211 | | 4/2002 |
| WO | 2004023913 | | 3/2004 |
| WO | 2004052133 | | 6/2004 |
| WO | 2005000059 | | 1/2005 |
| WO | 2007047923 | | 4/2007 |
| WO | 2008085108 | A1 | 7/2008 |
| WO | 2010001230 | | 1/2010 |
| WO | 2011084660 | | 7/2011 |
| WO | WO 2011/087435 | A1 | 7/2011 |
| WO | 2011148146 | | 12/2011 |
| WO | 2012047696 | | 4/2012 |
| WO | 2012074400 | | 6/2012 |
| WO | 2012099633 | | 7/2012 |
| WO | 2013033078 | A1 | 3/2013 |

OTHER PUBLICATIONS

Written Opinion of the International Search Authority from PCT/US2015/057894 dated Mar. 10, 2016 (3 pages).

European Extended Search Report issued in EP Application No. 14868227.1 dated May 16, 2017 (8 pages).

* cited by examiner

PROTECTIVE HELMET

CROSS REFERENCE TO RELATED APPLICATIONS

This document claims the benefit of the filing date of U.S. Provisional Patent Application 62/069,679 entitled "In-Mold Rotation Helmet" to Lowe, which was filed on Oct. 28, 2015, the contents of which are hereby incorporated by reference.

BACKGROUND

1. Technical Field

Aspects of this document relate generally to protective helmets.

2. Background Art

Conventional helmet system include comfort liners adjacent a protective shell of the helmet. While the comfort liner may improve comfort the wearer, the rotational movement of the comfort liner with respect to the protective shell is limited during impact due to the friction between the comfort liner and the protective shell.

SUMMARY

According to one aspect, a protective helmet comprises a protective shell, a low friction layer, and a comfort liner. The protective shell comprises an energy absorbing material and an inner surface. The low friction layer is coupled to the inner surface of the protective shell. The comfort liner is removably coupled to the low friction layer opposite the protective shell, and comprises a low friction material adjacent the low friction liner.

Various implementations and embodiments may comprise one or more of the following. The low friction material of the comfort liner may comprise brushed nylon. The low friction layer may comprise a plastic low friction layer comprising a thickness less than approximately 3 mm. The comfort liner may be removably coupled to the protective shell with one or more elastically deformable couplings that extend from the comfort liner through the low friction layer to the protective shell. The protective shell may comprise a receiver on a lower edge of the protective shell, the receiver extending into the protective shell from the lower edge of the protective shell, and the comfort liner may comprise a clip removably coupled within the receiver to couple the comfort liner to the protective shell with the low friction layer positioned between the protective shell and the comfort liner. A neck roll pad coupled to the comfort liner with a four-way stretch fabric.

According to another aspect, a protective helmet comprises a protective shell, a low friction layer and a comfort liner. The protective shell comprises an energy absorbing material and an inner surface. The low friction layer is coupled to the inner surface of the protective shell. The comfort liner is removably coupled to the low friction layer opposite the protective shell with one or more elastically deformable couplings that extend from the comfort liner through the low friction layer to the protective shell.

Various implementations and embodiments may comprise one or more of the following. The low friction layer may comprise a plastic low friction layer having a thickness of approximately 3 mm or less. The comfort liner may comprise a low friction material adjacent the low friction layer. The low friction material of the comfort liner may comprise brushed nylon. The protective shell may comprise a receiver on a lower edge of the protective shell, the receiver extending into the protective shell from the lower edge of the protective shell, and the comfort liner may comprise a clip removably coupled within the receiver to couple the comfort liner to the protective shell with the low friction layer positioned between the protective shell and the comfort liner. A neck roll pad coupled to the comfort liner with a four-way stretch fabric.

According to another aspect, a protective helmet comprises a protective shell and a comfort liner. The protective shell comprises an energy absorbing material, an inner surface, and a receiver on a lower edge of the protective shell, the receiver extending into the protective shell from the lower edge of the protective shell. The comfort liner is removably coupled to the inner surface of protective shell, and comprises a clip removably coupled within the receiver to removably couple the comfort liner to the protective shell.

Various implementations and embodiments may further comprise one or more of the following. The receiver may comprise a U-shaped slot extending inward into the protective shell from the bottom edge and a plurality of tabs extending inward within the U-shaped slot. A low friction layer coupled to the inner surface of the protective shell between the comfort liner and the protective shell. The low friction layer may comprise a plastic low friction layer having a thickness of approximately 3 mm or less. The comfort liner may comprise a low friction material adjacent the low friction layer. The low friction material comprises brushed nylon. The comfort liner may be removably coupled to the protective shell with one or more elastically deformable couplings that extend from the comfort liner through the low friction layer to the protective shell. A neck roll pad coupled to the comfort liner with a four-way stretch fabric.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The invention will hereinafter be described in conjunction with the appended drawings, where like designations denote like elements, and.

DESCRIPTION

Figure 1:
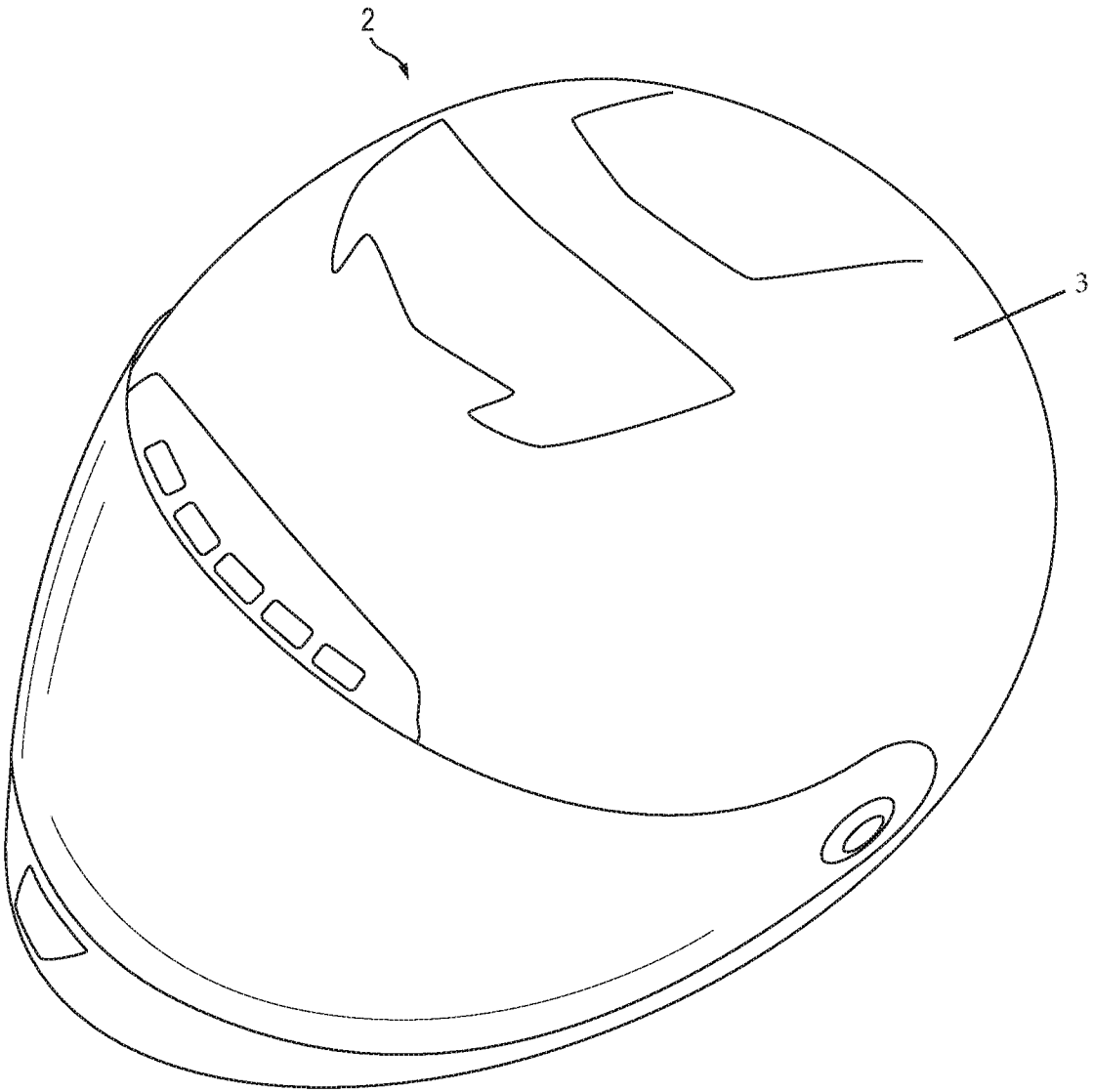
FIG. 1 is a top perspective view of a first embodiment of a protective helmet.

Protective head gear and helmets have been used in a wide variety of applications and across a number of industries including sports, athletics, construction, mining, military defense, and others, to prevent damage to a users head and brain. Damage and injury to a user can be prevented or reduced by preventing hard objects or sharp objects from directly contacting the user's head, and also from absorbing, distributing, or otherwise managing energy of the impact.

This disclosure, its aspects and implementations, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The words "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes embodiments of many different forms, there is shown in the drawings and will herein be described in detail particular embodiments with the understanding that the present disclosure is to be considered as an exemplification of the principles of the disclosed methods and systems, and is not intended to limit the broad aspect of the disclosed concepts to the embodiments illustrated.

Accordingly, this disclosure discloses protective headgear, as well as a system and method for providing a helmet or protective headgear, that can be used for a cyclist, football player, hockey player, baseball player, lacrosse player, polo player, climber, auto racer, motorcycle rider, motocross racer, skier, snowboarder or other snow or water athlete, sky diver or any other athlete, recreational or professional, in a sport. Other non-athlete users such as workers involved in industry, including without limitation construction workers or other workers or persons in dangerous work environments can also benefit from the protective headgear described herein, as well as the system and method for providing the protective head gear.

Figure 2:
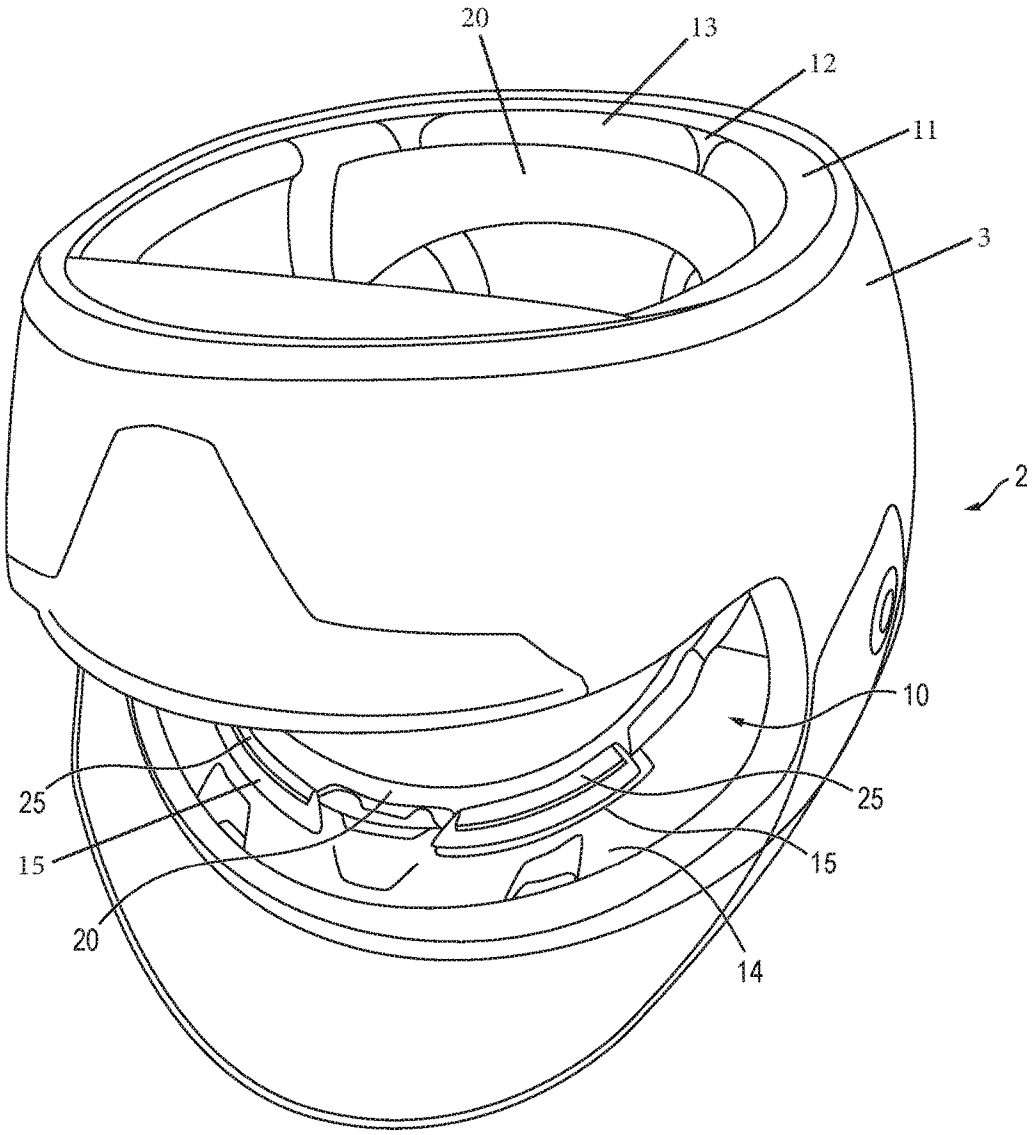
FIG. 2 is a bottom perspective view of a first embodiment of a protective helmet.
Figure 3:
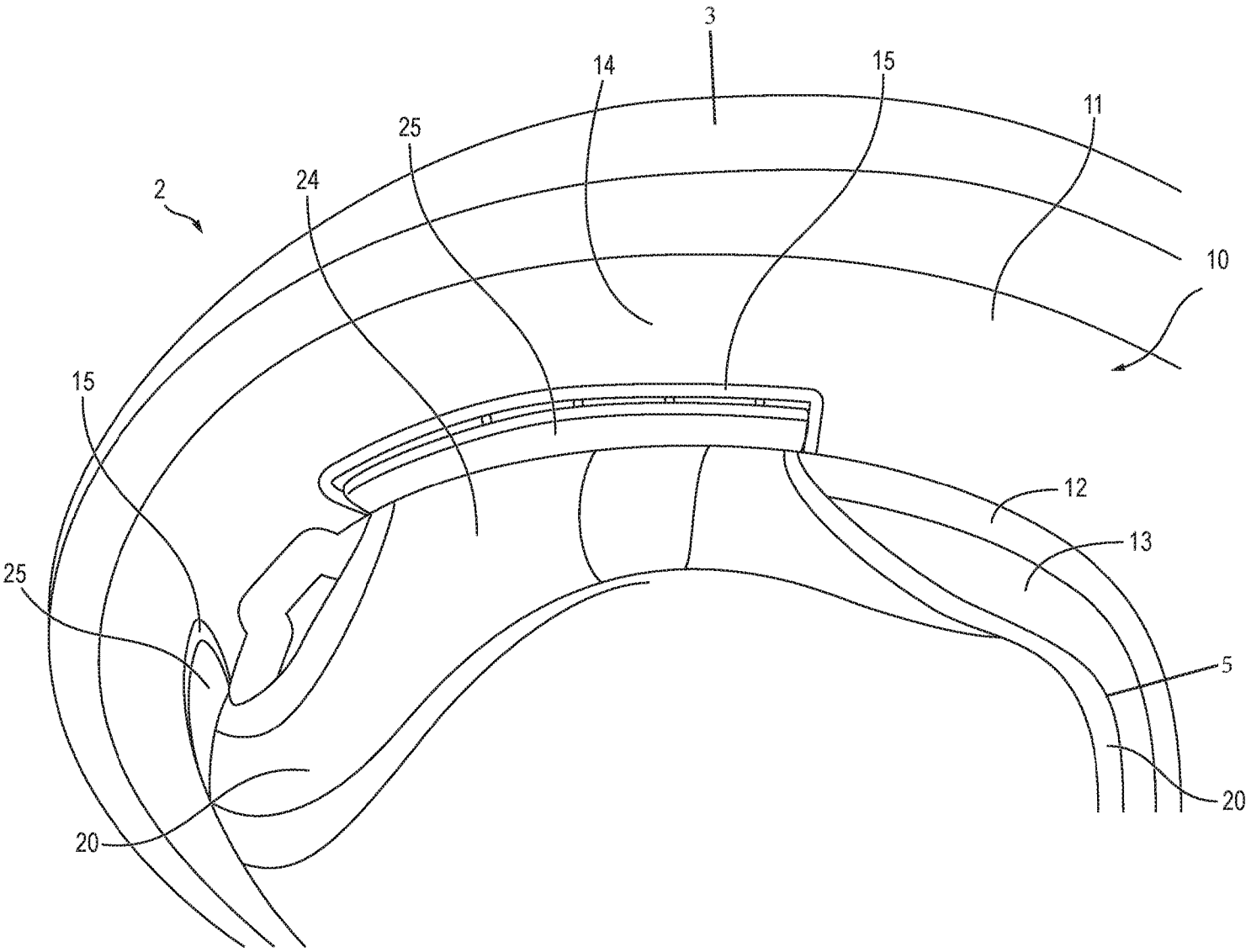
FIG. 3 is a bottom view of a brow of a first embodiment of a protective helmet with a clip of a comfort liner coupled to a receiver on the protective shell.
Figure 4:
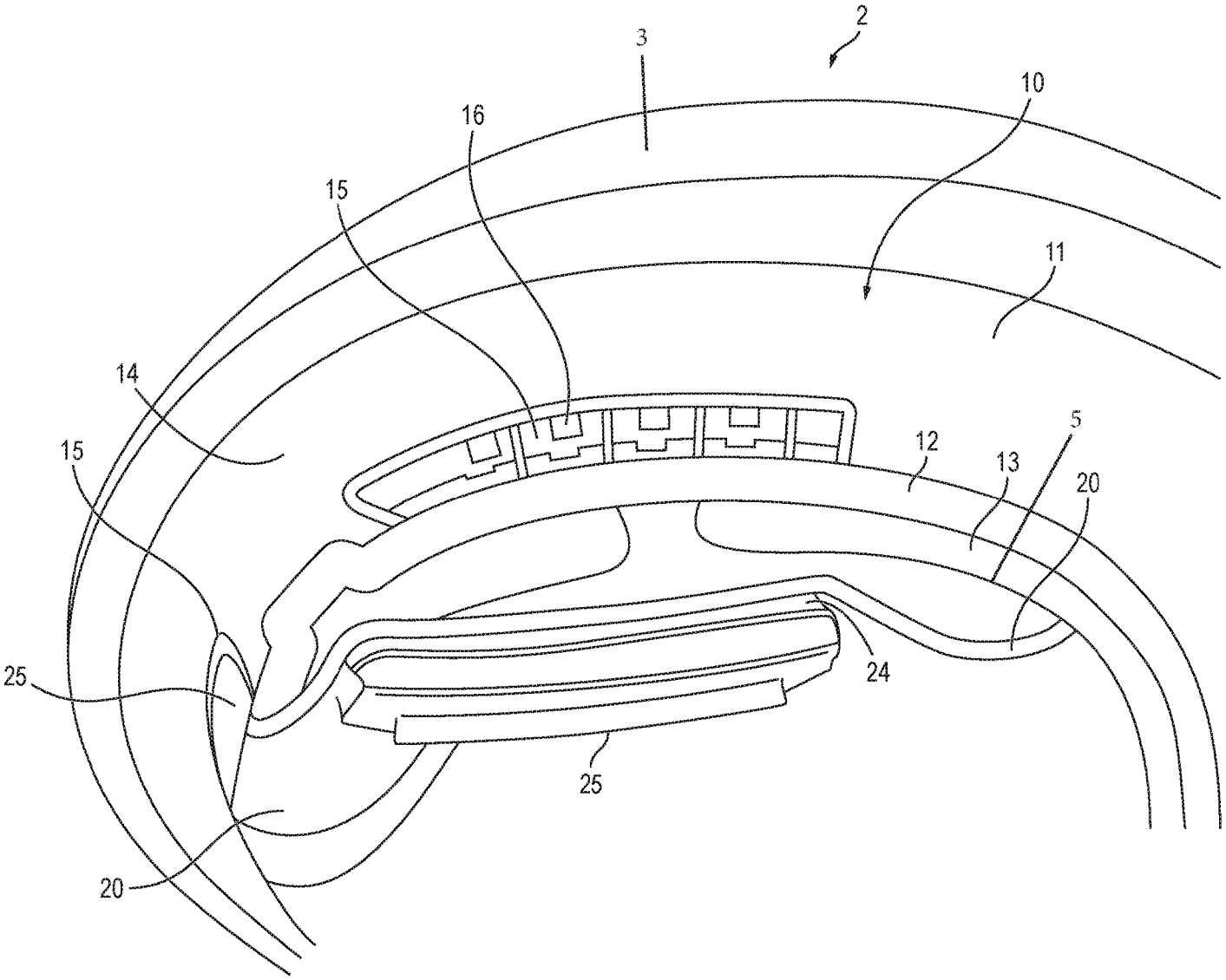
FIG. 4 is a bottom view of a brow of a first embodiment of a protective helmet with a clip of a comfort liner detached from a receiver on the protective shell.

Various implementations and embodiments of protective helmets according to this disclosure comprise a protective shell 10. The protective shell 10 can be made of an energy absorbing material, such as expanded polystyrene (EPS), expanded polyurethane (EPU), expanded polyolefin (EPO), expanded polypropylene (EPP), or other suitable energy managing material. The energy absorbing material can be part of a hard-shell helmet such as a skate bucket helmets, motorcycle helmets, snow sport helmets, football helmets, batting helmets, catcher's helmets, or hockey helmets. As shown in FIGS. 2-4, the disclosed protective helmets include an additional outer protective shell 3 disposed outside, or over, the protective shell 10. In other words, FIGS. 2-4 show an outer shell 3 that is disposed outside of, or over, the energy absorbing material. In hard shell applications, the energy absorbing material can comprise one or more layers of EPP and provide more flexibility than available with conventional in-molded helmets. Alternatively, the energy absorbing material can be part of an in-molded helmet such as bicycle helmet or cycling helmet. Because bicycle helmets typically include openings in the energy absorbing material for ventilation to airflow can through the helmet and cooling of a wearer's head, cycling applications could require modified low friction layers. As an energy-absorbing layer in an in-molded helmet, the protective shell 10 can comprise rigid materials such as EPS and EPU. The additional outer shell layer 3, such as a layer of stamped polyethylene terephthalate (PET) or a polycarbonate shell, can be included on an outer surface of the protective shell 10 of the helmet and be bonded directly to the expanding foam (e.g. PET layer added the to the EPS as it is expanding such that the foam is molded in the shell). In other words, the additional outer shell 3 that is directly connected to the energy absorbing material is shown in FIGS. 2-4.

FIGS. 1-4 depict a non-limiting embodiment of a protective helmet 2 according to this disclosure. In one or more embodiments, a protective shell 10 comprises a plurality of layers of energy absorbing material coupled to one another. For example, in the non limiting embodiment of a protective helmet 2 shown in FIGS. 3 and 4, the protective shell 10 comprises a first layer 11, a second layer 12, and a third layer 13 of energy absorbing material coupled to one another to form a protective shell 10. As shown in FIGS. 2-4, the outer surface of the first layer 11 of the energy absorbing material is positioned adjacent to and is connected to the inner surface of the additional outer shell 3. In embodiments comprising a plurality of layers of energy absorbing material coupled to one another, the inner surface of the protective shell 10 is the inner surface of the innermost layer of energy absorbing material. For example, in the non-limiting embodiment shown in FIGS. 3 and 4, the inner surface of the protective shell 10 is the inner surface of the third layer 13 of energy absorbing material (not visible in FIGS. 3 and 4), the inner surface of the third layer 13 of energy absorbing material being directed to or facing the head of the wearer when the protective helmet 2 is worn. In other embodiments, such as the non-limiting embodiment of a protective helmet 4 depicted in FIG. 5, a protective shell 8 may comprise a single layer of energy absorbing material. In such an embodiment, the inner surface 9 is also directed to or facing the head of the wearer when the protective helmet 4 is worn. Embodiments of a protective shell may also include an outer surface formed opposite the inner surface that may be oriented away from the wearer's head.

Figure 5:
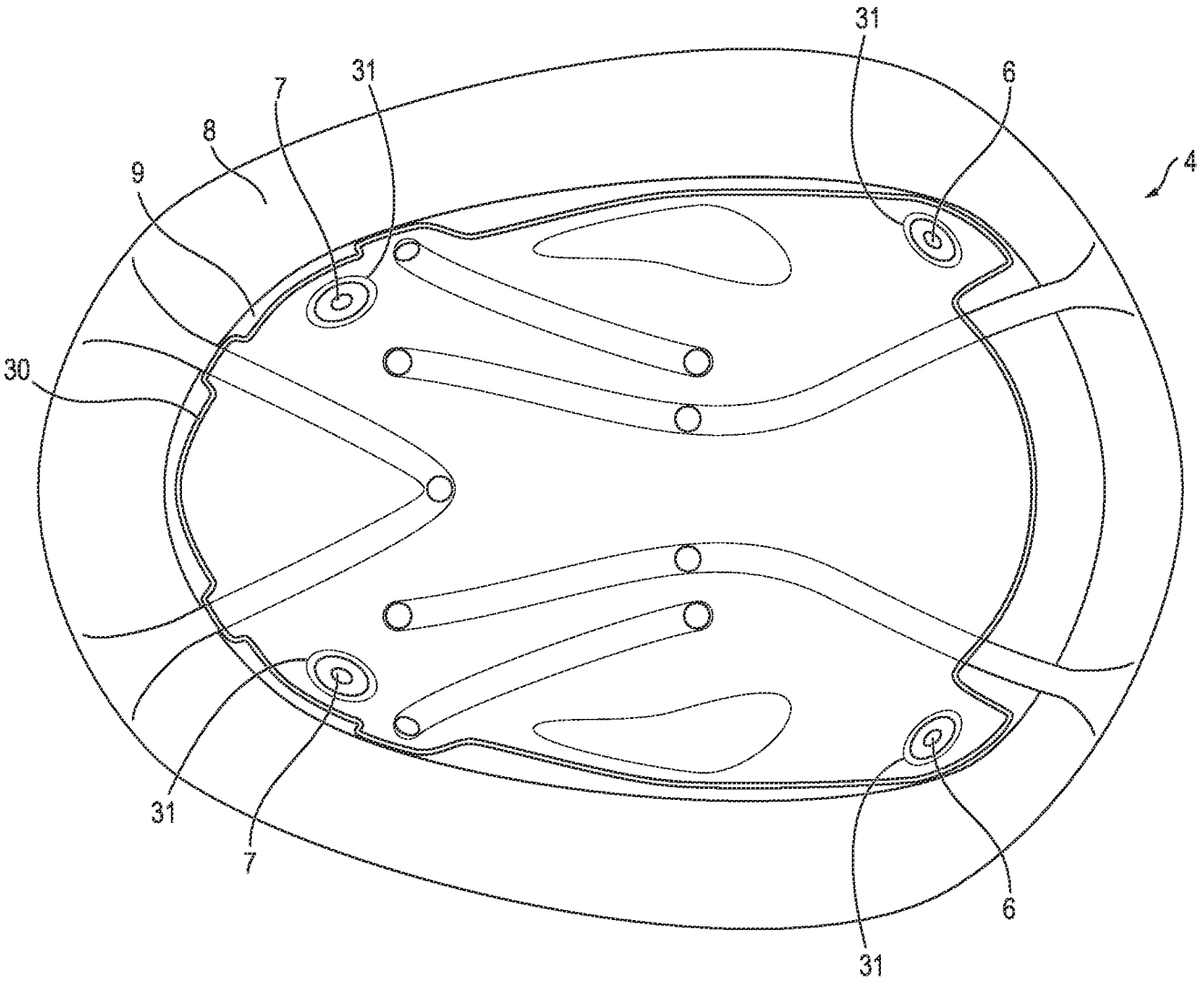
FIG. 5 is a bottom view of a second embodiment of a protective helmet.

Various implementations and embodiments of protective helmets contemplated in this disclosure may further comprise a low friction layer 30 (shown in FIG. 5) coupled to an inner surface 9 of a protective helmet. Although a low friction layer 30 is not visible in the non-limiting embodiment shown in FIGS. 1-4, one or ordinary skill in the art will understand how the low friction layer 30 shown coupled to a protective helmet 4 in FIG. 5 may be applied to other protective helmets. The non-limiting example of a low friction layer 30 in FIG. 5 is formed of a transparent plastic. Although reference is made below to the inner surface 9 of the protective shell 8 of the protective helmet 4 shown in FIG. 5, it is contemplated that a low friction layer 30 having similar features may be applied to the protective helmet 2 shown in FIGS. 1-4. By forming a thin low friction layer 30, such as is described herein, the low friction layer 30 may provide for rotational energy management without requiring additional thick or bulky layers between the outer surface of the helmet and the wearer's head. As such, embodiments of providing rotational energy management contemplated as part of this disclosure may be implemented with conventional helmet designs, sizes, and dimensions, without interfering with helmet fit, or requiring helmet redesigns to accommodate improvements for rotational energy management.

According to some aspects, a low friction layer 30 may be formed of plastic, such as PET or polycarbonate, as well as other materials such as carbon fiber, fiberglass, or any other suitable material that provides a low friction inner surface that is oriented towards the head of a wearer and positioned to interface a comfort liner (described in greater detail below). In one or more embodiments, a low friction layer 30 comprises a contoured surface that follows a contour, topography, or shape of the inner surface 9 of the protective shell 8. A topography, shape, or geometry of the low friction layer 30 may also account for helmet ventilation. According to some aspects, a low friction layer 30, whether contoured or not contoured, comprises a thickness in a range of 0-3 mm, or a thickness less than 1 mm. A low friction layer 30 may also include projections, tabs, or pegs that can be perpendicular with, or extend away from, the contoured surface of the low friction layer 30 and be imbedded within the protective shell 8 to secure the low friction layer 30 to the protective shell 8, as shown in FIG. 5. A low friction layer 30 may be coupled to the inner surface 9 of a protective shell 8, especially for in-molded helmets, as a plastic shell formed of in-molded polycarbonate, PET, or other suitable plastic in a way that is the same or similar to a way in which outer plastic shells 3 can be coupled to in-molded helmets. A low friction layer 30 may also be coupled to the protective shell 8 after the protective shell 8 is fully formed. In some instances, a protective shell 8 is added or retrofitted to an existing helmet as part of an after-purchase or after market upgrade to increase protection and management of energy through rotational movement.

Various implementations and embodiments of a protective helmet according to this disclosure may further comprise a comfort liner coupled to the protective shell of the helmet. In some embodiments, a comfort liner is removably coupled to a protective shell of a helmet with the low friction layer positioned between the comfort liner and the protective shell. Various embodiment of comfort liners according to this disclosure may be removably coupled to a protective shell with multiple embodiments of couplings, which shall be described in greater detail below. When coupled to a protective shell, a comfort liner may be disposed within the protective shell of helmet and oriented towards the inner surface of the protective shell of the helmet to provide additional cushion and padding to a wearer's head, while also minimizing, reducing, and filling-in gaps or offsets that might exists between the wearer's head and the protective shell.

Figure 6:
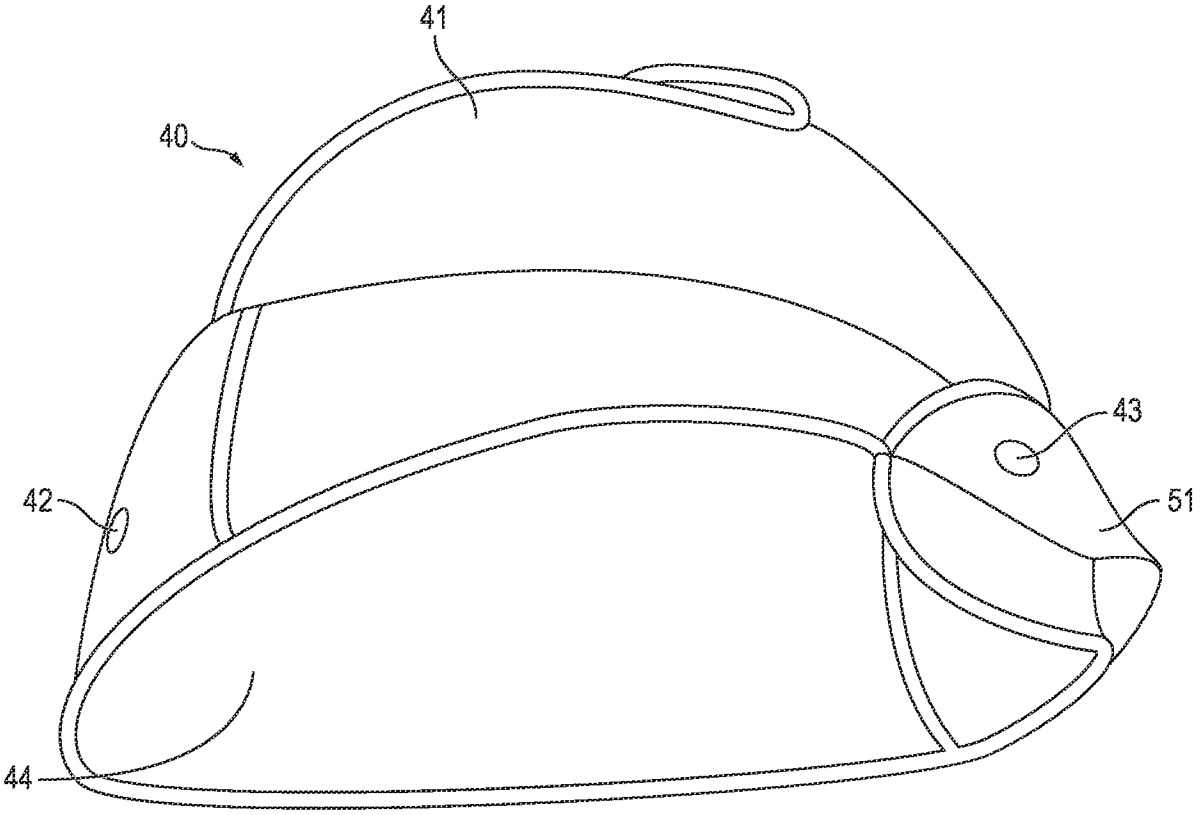
FIG. 6 is a side view of a first embodiment of a comfort liner.

FIG. 6 depicts a non-limiting embodiment of a comfort liner 40 according to this disclosure. In one or more embodiments, an outer surface 41 (i.e. the surface that is oriented towards the protective shell of the helmet and away from the wearer's head) comprises exposed padding or raw foam. In other embodiments, a comfort liner 40 comprises an outer surface 41 having a low friction material covering the padding or raw foam. A low friction material may comprise brushed nylon or an equivalent fabric. By including a low friction material such as brushed nylon on an outer surface 41 of the comfort liner 40, slipping, rotation, and relative movement between the comfort liner 40 and the low friction layer 30 may be promoted or increased such that a wearer's head remains in fixed contact relative to the comfort liner 40 while slipping, rotating, and moving against the low friction liner 30 with respect to the protective shell of the helmet.

A comfort liner 40 according to this disclosure may be formed as unitary or monolithic padded interiors, such as those formed with one-piece sewn basket construction. Unitary construction of the comfort liner allows for reducing or minimizing a number of attachment devices or anchoring points, as discussed in greater detail below. When a comfort liner 40 is disposed adjacent the low friction layer, the comfort liner 40 may be coupled to the protective shell of the helmet with at least one elastically deformable coupling that facilitates rotation and relative movement of the comfort liner 40 with respect to the low friction layer 30. In the non-limiting embodiment shown in FIG. 6, a comfort liner comprises at least one front elastically deformable coupling 42 and at least one rear elastically deformable coupling 43. The elastically deformable coupling may be displaced and absorb energy during an impact and then return to an original position after impact.

One or more embodiments of a comfort liner 20, such as the comfort liner 20 shown in the non-limiting embodiment depicted in FIGS. 3 and 4, comprise one or more straps 24 and one or more attachment devices or clips 25. Each strap 24 extends between the body of the comfort liner 20 and the attachment device or clip 25. In the non-limiting embodiment shown in FIGS. 3 and 4, the comfort liner 20 comprises two front straps 24 and two front attachment devices or front clips 25, wherein each front attachment device or front clip 25 is coupled to a front strap 24. The front straps 24 and clips 25 are positioned to allow a user to removably couple the attachment devices or clips 25 to a front brow or front lower edge 14 of a protective shell 10 of the helmet 2. In some embodiments, a comfort liner 20 may comprise one or more rear straps 24 and one or more rear attachment devices or clips 25 similar to that shown in FIGS. 3 and 4 positioned to removably couple the comfort liner 20 to a rear brow or lower edge of a helmet 2. The straps 24 may be adjustable straps 24 that allow a user to adjust a length of the strap 24. In particular embodiments, the clips 25 may couple into the front brow of the helmet 2 substantially perpendicularly to the front brow surface. Various embodiments may comprise one or more clips 25 and one or more elastically deformable couplings 42, 43. For example, a comfort liner 20 may comprise two front clips 25 and two rear elastically deformable couplings 43. Other embodiments may comprise two front clips 25, two front elastically deformable couplings 42, and two rear elastically deformable couplings 43. Still other embodiments may comprise two rear clips 25 and two front elastically deformable couplings 42. Other embodiments may comprise any combination thereof.

As noted above, one or more embodiments of a helmet 4 may comprise at least on elastically deformable coupling 42, 43 coupling the comfort liner 40 to the protective shell 8 of the helmet 4. An elastically deformable coupling 42, 43 may comprise a rubber snap, stopper, or bungees that can be releasably or permanently coupled to the comfort liner 40 and to the protective shell 8. However, any number or type of suitable attachment devices can be used, as desired, according to the particular needs and application of the helmet. For example, while any number of attachment devices can be used for power sports helmets, some power sports helmets can include four attachment devices (like clips 25) disposed along a lower edge or perimeter of the comfort liner, as shall be described in greater detail below. For some power sports helmets, a comfort liner 40 or padding can be coupled to the exterior perimeter or lower drip-line of the helmet. Accordingly, the padding can be coupled to the helmet by being sandwiched between an energy absorbing layer (such as EPS) and an outer shell 3 without any additional attachment devices, such as snaps, because the fit between the outer shell 3 and the energy absorbing layer can function as the attachment device.

For applications involving snow helmets, a sewn basket style pad assembly may be used and coupled to the low friction layer 30 of the protective shell 8. For applications involving bike or cycling helmets, the comfort liner 30 can be coupled to the low friction layer 30 or protective shell 8 as a mesh layer or with openings to accommodate ventilation openings and airflow through the helmet, and a comfort liner comprising plurality of smaller portions or discrete pieces may be used.

In one or more embodiments, an elastically deformable coupling 42, 43 may couple the comfort liner 40 to the protective shell 8 by at least one of the elastically deformable couplings 42, 43 extending through an opening 31, hole, or cut-out of the low friction layer 30. Alternatively, a shape of the low friction layer 30 can be such that the elastically deformable coupling 42, 43 may couple the low friction layer 30 to the protective shell 8 without passing through the low friction layer 30, such as being disposed around a periphery of the low friction layer 30. In yet another embodiment, the elastically deformable coupling may couple the comfort liner 40 directly to the low friction layer 30. In the non-limiting embodiment shown in FIG. 6, each elastically deformable coupling 42, 43 is configured to extend away from the comfort liner 40, through the low friction layer 30 and be coupled directly to the protective shell 8.

As a non-limiting example, an elastically deformable coupling 42, 43 may pass through a circular opening 31 in the clear plastic shell of the low friction layer 30, and snap into a circular opening 7, 6 on the inner surface 9 of the protective shell 8 aligned with the circular opening 31 in the low friction layer 30. Each elastically deformable coupling 42, 43 may thus be coupled at its ends to the protective shell 8 and the comfort liner 40, with a distance or length in-between that allows for elastic movement. Each elastically deformable coupling 42, 43 may be held at its respective ends in the protective shell 8 and comfort layer 40 by a chemical attachment, such as by an adhesive, or by mechanical attachment. Mechanical attachment can include sewing, interlocking, or friction.

In some instances, each elastically deformable coupling 42, 43 comprises an "I" shape with top and bottom widened portions and a narrower central portion. The top widened portion can include a head, tab, or flange, an underside of which contacts the comfort liner 40 around an opening in the comfort liner 40 through which the elastically deformable coupling 42, 43 can pass. The bottom-widened portion can include a head, tab, flange or barbs that contact an inner portion of the opening in the protective shell for receiving the elastically deformable coupling. In any event, the elastically deformable couplings 42, 43 can couple the comfort liner 40 to the protective shell in such a way as to allow a range of motion or relative movement along the low friction layer 30 and with respect to the protective shell 8. The range of motion can be adjusted to a desirable layer amount or distance by adjusting a size, elasticity, or other feature of the elastically deformable couplings.

According to some aspects and as noted above, a comfort liner 20 may be coupled to a protective shell 10 with one or more attachment devices or clips 25. Each attachment device or clip 25 may comprise an elongated attachment device or clip 25 sized to friction or compression fit within a receiver 15 on the protective shell 10 of the helmet 2. In other embodiments, the attachment device or clip 25 may comprise a buckle or any other coupling configured to allow a user to removably couple the attachment device or clip 25 to the brow or lower edge 14 of the helmet 2. As noted, various embodiments of a protective helmet 2 comprise one or more receivers 15 embedded within a protective shell 10 of the helmet 2 and positioned to receive an attachment device or clip 25. As shown in FIGS. 2-4, the receivers 15 are positioned between an inner surface 5 of the energy absorbing material and an outer surface of the energy absorbing material. In particular, FIGS. 3 and 4 show the front receiver positioned near the middle of the energy absorbing material, wherein a majority of the first layer 11 positioned outward of the receiver 15 and the second layer 12 and a third layer 13 are positioned inward of the receiver 15. As used herein, the brow or lower edge 14 of the helmet 2 is the portion of the protective shell 10 just above the eyebrows of the user. The lower edge may also include the edge just above the rear side of the neck of the user. In any event, as used herein, the brow or lower edge 14 of the helmet 2 extends at an angle away from the face or neck of the wearer or from the center of the helmet 2. The lower edge 14, then, comprises a latitudinal edge on the helmet 2 extending outward from the center of the helmet 2. When an attachment device or clip 25 is detachably coupled to receiver 15, the attachment device or clip 25 extends into the receiver 15 substantially perpendicular to the latitudinal lower edge 14 of the protective shell 10. This coupling of the attachment device or clip 25 with the receiver 15 provides a connection that is positioned inward of both the outer shell 3 and the outer surface of the energy absorbing material. In one or more embodiments, the attachment device or clip 25 is substantially perpendicular to a surface upon which the helmet 2 rests (or the ground upon which the wearer stands) when the attachment device or clip 25 is detachably coupled to the receiver 15 embedded within the protective shell 10 of the helmet 2 (assuming the helmet 2 is upright).

Each receiver 15 is configured to removably couple the attachment device or clip 25 to the receiver 15 and thus the protective shell 10 in which the receiver 15 is embedded. Each receiver 15 may comprise one or more teeth 16 configured to pinch a portion of the attachment device or clip 25 and hold the attachment device or clip 25 partially within the receiver 15. Like the elastically deformable couplings 42, 43, the clips 25 and receivers 15 couple the comfort liner 20 to the protective shell 10 in such a way as to allow a range of motion or relative movement along the low friction layer 30 and with respect to the protective shell 10. The range of motion can be adjusted to a desirable layer amount or distance by adjusting the length of the strap 14.

Figure 7:
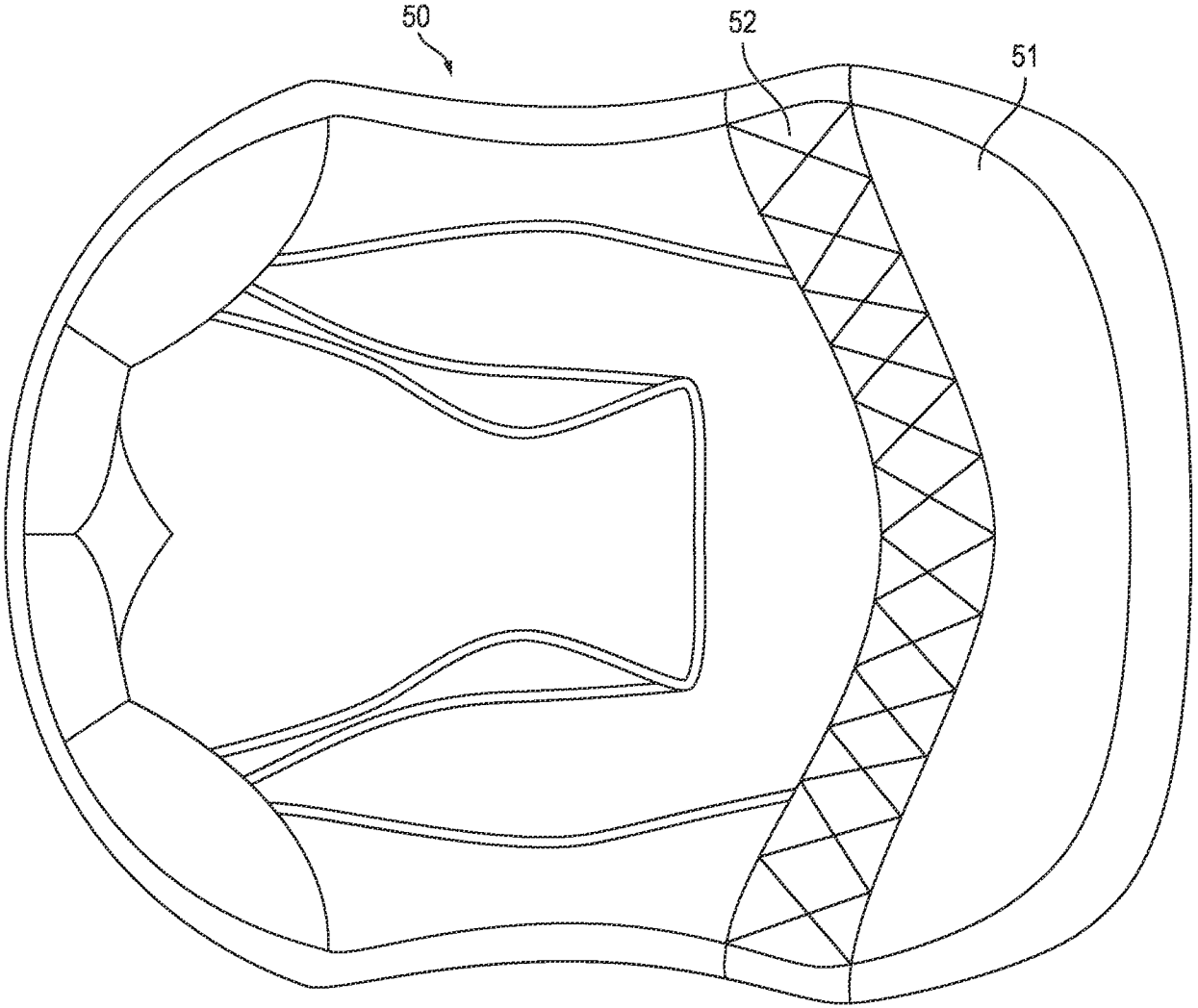
FIG. 7 is a bottom view of a second embodiment of a comfort liner.

Also contemplated in this disclosure is a comfort liner 50 comprising a four-way stretch fabric 52 coupling a neck roll 51 of the comfort liner 50 the main body of the comfort liner 50. FIG. 7 depicts a bottom view of a comfort liner 50 comprising a four-way stretch fabric 52 coupling a neck roll 51 to the comfort liner 50. Such a configuration provides more free movement of the comfort liner 50 against the low friction layer 30 described above. In some embodiments, the neck roll 51 is directly and removably coupled to either the low friction layer 30 or the protective shell 10 with elastically deformable couplings 43 or clips 25, as described above. In other embodiments, the neck roll 51 is not directly coupled to either the protective shell 10 or the low friction layer 30.

It will be understood that implementations are not limited to the specific components disclosed herein, as virtually any components consistent with the intended operation of a method and/or system implementation for helmets may be utilized. Accordingly, for example, although particular protective shells and comfort liners may be disclosed, such components may comprise any shape, size, style, type, model, version, class, grade, measurement, concentration, material, weight, quantity, and/or the like consistent with the intended operation of a method and/or system implementation for a helmet may be used.

In places where the description above refers to particular implementations of helmets, it should be readily apparent that a number of modifications may be made without departing from the spirit thereof and that these implementations may be applied to other helmets. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A protective helmet, comprising:

an outer shell having an inner surface and a lower edge;

an energy absorbing material having an inner surface and an outer surface, wherein the outer surface of the energy absorbing material is directly connected to the inner surface of the outer shell;

a front receiver positioned adjacent to the lower edge of the outer shell and between the inner surface and outer surface of a front region of the energy absorbing material;

a comfort liner configured to contact a head of a wearer of the protective helmet, the comfort liner has: (i) a body, (ii) a front strap that extends from the body and includes a front attachment device, and (iii) an elastically deformable coupler that extends from an outer surface of the comfort liner; and wherein the comfort liner is removably coupled within the protective helmet when: (i) an extent of the front attachment device is connected to the front receiver to provide a front connection that is positioned between the inner surface of the energy absorbing material and the outer surface of the energy absorbing material and (ii) the elastically deformable coupler extends into an opening formed within the energy absorbing material.

2. The protective helmet of claim 1, wherein the comfort liner includes an outer surface, said outer surface is covered with a material comprised of brushed nylon.

3. The protective helmet of claim 1, further comprising a plastic layer that has a thickness less than approximately 3 mm, wherein the plastic layer is positioned between the comfort liner and the energy absorbing material.

4. A protective sports helmet, comprising: an outer shell having an inner surface and a lower edge; an energy absorbing material having an inner surface and an outer surface, wherein the outer surface of the energy absorbing material is directly connected to the inner surface of the outer shell; a front receiver positioned directly adjacent to the lower edge of the outer shell and between the inner surface and outer surface of a front region of the energy absorbing material; a plastic layer coupled to an extent the inner surface of the energy absorbing material; a comfort liner configured to contact a head of a wearer of the protective helmet, said comfort liner has: i) a body, ii) a front strap that extends from the body and includes a front attachment device, and iii) at least two elastically deformable couplers that from an outer surface of the comfort liner; and wherein the outer surface of the comfort liner is removably positioned adjacent to the plastic layer when: i) the front attachment device is connected to the front receiver to provide a front connection that is positioned inward of the outer surface of the energy absorbing material, and ii) each of the elastically deformable couplers extends into a respective hole in the plastic layer.

5. The protective sports helmet of claim 4, wherein the plastic layer has a thickness of approximately 3 mm or less.

6. The protective sports helmet of claim 4, wherein the outer surface of the comfort liner is comprised of brushed nylon.

7. A protective helmet, comprising:

an outer shell having an inner surface and a lower edge;

an energy absorbing material having an inner surface and an outer surface, wherein the outer surface of the energy absorbing material is directly connected to the inner surface of the outer shell;

a front coupler bordering the lower edge of the outer shell and positioned between the inner surface and outer surface of a front region of the energy absorbing material;

a plastic layer coupled to the inner surface of the energy absorbing material wherein the plastic layer has at least one projection that extends from the plastic layer into the energy absorbing material;

a comfort liner configured to contact a head of a wearer of the protective helmet, the comfort liner having: (i) a body that includes a foam layer and (ii) a front attachment device; and wherein the comfort liner is removably secured within the protective helmet when an extent of the front attachment device is coupled with the front coupler.

8. The protective helmet of claim 7, wherein the front coupler comprise a U-shaped slot extending inward into the energy absorbing material from a bottom edge of the energy absorbing material.

9. The protective helmet of claim 7, wherein the plastic layer has a thickness of 3 mm or less.

10. The protective helmet of claim 7, wherein the comfort liner has an outer layer that is comprised of brushed nylon.

11. The protective helmet of claim 9, wherein the comfort liner includes an elastically deformable coupler that extends from an outer surface of the comfort liner, said elastically deformable coupler removably connects the comfort liner to the energy absorbing material when an extent of the elastically deformable coupler extends through a hole in the plastic layer.

12. The protective helmet of claim 1, wherein the energy absorbing material is made from polyurethane.

13. The protective helmet of claim 1, wherein the extent of the front attachment device is positioned substantially perpendicular to a latitudinal lower front edge of the energy absorbing material, when the extent of the front attachment device is connected to the front receiver.

14. The protective helmet of claim 3, wherein the plastic layer includes a plurality of projections that extend away from an outer surface of the plastic layer; and when the plastic layer is coupled to the energy absorbing material, an extent of said projections are imbedded within the energy absorbing material.

15. The protective helmet of claim 1, wherein the elastically deformable coupler is configured to be displaced during an impact and then return to an original position after the impact.

16. The protective sports helmet of claim 4, wherein the front region of the energy absorbing material includes a first layer and a second layer, said first layer is is made from polyurethane.

17. The protective sports helmet of claim 4, wherein an extent of the front attachment device is positioned substantially perpendicular to a lower front edge of the energy absorbing material.

18. The protective helmet of claim 1, wherein the front receiver includes a recessed structure that is positioned within an extent of the energy absorbing material.

19. The protective helmet of claim 1, wherein the front receiver includes at least one tooth.

20. The protective sports helmet of claim 4, wherein the front receiver includes at least one tooth.

21. The protective sports helmet of claim 20, wherein the at least one tooth is positioned within a recessed structure.

22. The protective helmet of claim 7, wherein the front coupler includes a front receiver having a plurality of teeth.

23. The protective helmet of claim 22, wherein the front receiver includes a recessed structure that is positioned within an extent of the energy absorbing material.

* * * * *